US011401815B2

(12) United States Patent
Zhou

(10) Patent No.: US 11,401,815 B2
(45) Date of Patent: Aug. 2, 2022

(54) BLADED ROTOR SYSTEM AND CORRESPONDING METHOD OF SERVICING

(71) Applicant: Siemens Energy Global GmbH & Co. KG, Munich (DE)

(72) Inventor: Yuekun Zhou, Charlotte, NC (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/413,966

(22) PCT Filed: Dec. 20, 2018

(86) PCT No.: PCT/US2018/066730
§ 371 (c)(1),
(2) Date: Jun. 15, 2021

(87) PCT Pub. No.: WO2020/131062
PCT Pub. Date: Jun. 25, 2020

(65) Prior Publication Data

US 2022/0034229 A1 Feb. 3, 2022

(51) Int. Cl.
*F01D 5/10* (2006.01)
*F01D 5/22* (2006.01)
(Continued)

(52) U.S. Cl.
CPC ..... *F01D 5/10* (2013.01); *F01D 5/22* (2013.01); *F01D 5/26* (2013.01); *F01D 5/3007* (2013.01);
(Continued)

(58) Field of Classification Search
CPC ..... F01D 5/10; F01D 5/22; F01D 5/26; F01D 25/06; F01D 11/008; F04D 29/668;
(Continued)

(56) References Cited

U.S. PATENT DOCUMENTS

2006/0177312 A1* 8/2006 Tomita ..... F01D 5/22 416/193 A
2013/0177427 A1 7/2013 Kayser
(Continued)

FOREIGN PATENT DOCUMENTS

EP 2434098 A1 3/2012
EP 2484870 A1 8/2012
(Continued)

OTHER PUBLICATIONS

PCT International Search Report and Written Opinion of International Searching Authority dated Sep. 20, 2019 corresponding to PCT International Application No. PCT/US2018/066730 filed Dec. 20, 2018.

*Primary Examiner* — Christopher Verdier

(57) ABSTRACT

A bladed rotor system for a turbomachine includes a circumferential row of blades mounted on a rotor disc, and includes a plurality of under-platform dampers. Each damper is located between adjacent blade platforms. The plurality of dampers includes a first set of dampers and a second set of dampers. The dampers of the first set are distinguished from the dampers of the second set by a cross-sectional material distribution in the damper that is unique to the respective set. Dampers of the first set and the second set are positioned alternately in a periodic fashion in a circumferential direction, to provide a frequency mistuning to stabilize flutter of the blades.

13 Claims, 4 Drawing Sheets

(51) Int. Cl.
*F01D 5/26* (2006.01)
*F01D 5/30* (2006.01)
*F01D 25/06* (2006.01)

(52) U.S. Cl.
CPC ..... *F01D 25/06* (2013.01); *F05D 2230/60* (2013.01); *F05D 2230/70* (2013.01); *F05D 2230/72* (2013.01); *F05D 2230/80* (2013.01); *F05D 2260/961* (2013.01); *F05D 2300/6033* (2013.01)

(58) Field of Classification Search
CPC ..... F05D 2260/96; F05D 2260/961; F05D 2230/72; F05D 2230/60; F05D 2230/70; F05D 2230/80; F05D 2300/6033
See application file for complete search history.

(56) References Cited

U.S. PATENT DOCUMENTS

| | | | |
|---|---|---|---|
| 2015/0167479 | A1 | 6/2015 | Hartung et al. |
| 2016/0024928 | A1 | 1/2016 | Hartung et al. |
| 2017/0067349 | A1 | 3/2017 | Kareff et al. |
| 2017/0275999 | A1* | 9/2017 | Weaver ..... F01D 5/282 |

FOREIGN PATENT DOCUMENTS

| | | | |
|---|---|---|---|
| EP | 2884050 | A1 | 6/2015 |
| EP | 2977553 | A1 | 1/2016 |
| EP | 3139002 | A1 | 3/2017 |
| WO | 2018175356 | A1 | 9/2018 |

* cited by examiner

View IV-IV

View VI-VI

BLADED ROTOR SYSTEM AND CORRESPONDING METHOD OF SERVICING

BACKGROUND

1. Field

The present invention relates to rotating blades in a turbomachine, and in particular, to a row of blades with alternate frequency mistuning for improved flutter resistance.

2. Description of the Related Art

Turbomachines, such as gas turbine engines include multiple stages of flow directing elements along a hot gas path in a turbine section of the gas turbine engine. Each turbine stage comprises a circumferential row of stationary vanes and a circumferential row of rotating blades arranged along an axial direction of the turbine section. Each row of blades may be mounted on a respective rotor disc, with the blades extending radially outward from the rotor disc into the hot gas path. A blade includes an airfoil extending span-wise along the radial direction from a root portion to a tip of the airfoil.

Typical turbine blades at each stage are designed to be identical aerodynamically and mechanically. These identical blades are assembled together into the rotor disc to form a bladed rotor system. During engine operation, the bladed rotor system vibrates in system modes. This vibration may be more severe in large blades, such as in low pressure turbine stages. An important source of damping in the modes is from aerodynamic forces acting on the blades when the blades vibrate. Under certain conditions, the aerodynamic damping in some of the modes may become negative, which may cause the blades to flutter. When this happens, the vibratory response of the system tends to grow exponentially until the blades either reach a limit cycle or break. Even if the blades achieve a limit cycle, their amplitudes can still be large enough to cause the blades to fail from high cycle fatigue.

Alternate frequency mistuning can cause system modes to be distorted, so that the resulting new, mistuned system modes are stable, i.e., they all have positive aerodynamic damping. It is therefore desirable to be able to design blades with a certain amount of predetermined alternate mistuning. Alternate mistuning may be implemented in blades by having the blades in the blade row alternate between high and low frequencies in periodic fashion in the circumferential direction. So far, alternate mistuning of blades has been implemented by modifying the mass and/or geometry of the airfoils in a periodic manner in a blade row.

However, there remains a room for improvement to better address the problem of blade vibration.

SUMMARY

Briefly, aspects of the present invention are directed to a row of blades with modified mass of under-platform dampers to provide alternate frequency mistuning for improved flutter resistance.

According to a first aspect of the invention, a bladed rotor system for a turbomachine is provided. The bladed rotor system comprises a circumferential row of blades mounted on a rotor disc. Each blade comprises a platform, a root extending radially inward from the platform for mounting the blade to the rotor disc, and an airfoil extending span-wise radially outward from the platform. During operation, platforms of adjacent blades align circumferentially to define an inner diameter boundary for a working fluid flow path. The bladed rotor system further includes a plurality of dampers, each damper being located between adjacent platforms. The plurality of dampers comprise a first set of dampers and a second set of dampers. The dampers of the first set are distinguished from the dampers of the second set by a cross-sectional material distribution in the damper that is unique to the respective set. Dampers of the first set and the second set are positioned alternately in a periodic fashion in a circumferential direction, to provide a frequency mistuning to stabilize flutter of the blades.

According to a second aspect of the invention, a method for servicing a bladed rotor system is provided. The bladed rotor system comprises a circumferential row of blades mounted on a rotor disc, each blade comprising a platform, a root extending radially inward from the platform for mounting the blade to the rotor disc, and an airfoil extending span-wise radially outward from the platform. The bladed rotor system further comprises a plurality of dampers, each damper being installed between adjacent platforms. The method comprises modifying a mass of at least a subset of the plurality of installed dampers or providing replacement dampers for at least a subset of the plurality of installed dampers. As a result, first and second sets of dampers are obtained, in which the dampers of the first set are distinguished from the dampers of the second set by a cross-sectional material distribution in the damper that is unique to the respective set. The method further comprises installing the modified or replacement dampers, such that dampers of the first set and the second set are positioned alternately in a periodic fashion in a circumferential direction, to provide a frequency mistuning to stabilize flutter of the blades.

BRIEF DESCRIPTION OF THE DRAWINGS

The invention is shown in more detail by help of figures. The figures show preferred configurations and do not limit the scope of the invention.

DETAILED DESCRIPTION

Figure 1:
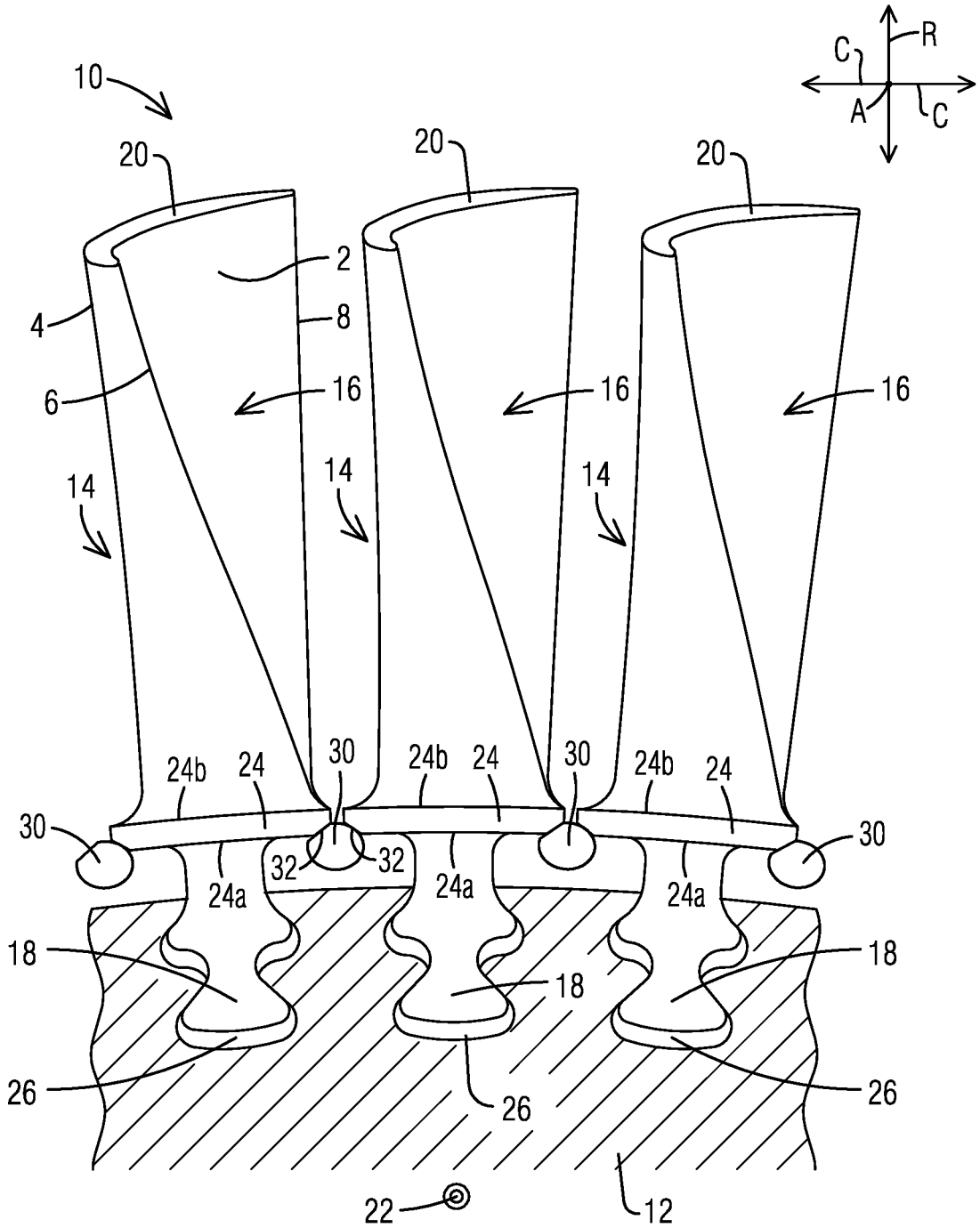
FIG. 1 schematically illustrates, in axial view, a portion of a bladed rotor system comprising under-platform dampers.

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the drawings, the direction A denotes an axial direction parallel to an axis of the turbine engine, while the directions R and C respectively denote a radial direction and a circumferential direction with respect to said axis of the turbine engine.

Referring now FIG. 1, a portion of a bladed rotor system 10 is illustrated. The bladed rotor system 10 includes a circumferential row of blades 14 mounted on a rotor disc 12. Each blade 14 comprises an airfoil 16 extending span-wise along a radial direction from a platform 24 to an airfoil tip 20. As known to one skilled in the art, the airfoil 16 may comprise a generally concave pressure side 2 and a generally convex suction side 4, joined at a leading edge 6 and at a trailing edge (not shown). The blade 14 is mounted on the disc 12 via an attachment structure, referred to as a blade root, which extends radially inward from the platform 24. In the illustrated embodiment, the root 18 has a fir-tree shape, which fits into a correspondingly shaped slot 26 in the rotor disk 12. In the context of the illustrated embodiments, it may be assumed that each blade 14 of the blade row has essentially identical fir-tree attachments. Each platform 24 comprises a radially inner surface 24*a* and a radially outer surface 24*b*. In operation, the platforms 24 of adjacent blades 14 align circumferentially, without necessarily contacting each other. The circumferential alignment of the radially outer surfaces 24*b* of neighboring platforms 24 form an inner diameter flow path boundary for a working fluid of the turbomachine. The airfoils 16 extend radially outward into the flow path and extract energy from the working fluid, which causes the blades 14 to rotate about a rotation axis 22.

As the airfoils 16 extract energy from the working fluid, the working fluid exerts a loading force on the airfoils 16. Variations in the loading force may cause the blades 14 to deflect and vibrate. This vibration may have a broad spectrum of frequency components, with greatest amplitude at the natural resonant frequency of the blades 14. When the blades 14 are unshrouded, the vibration is primarily tangential to the direction of rotation, i.e. the circumferential direction. There may also be a secondary vibration component in the direction of fluid flow, i.e. the axial direction. The above-mentioned vibrations may be reduced by incorporating under-platform dampers 30. Each damper 30 may be constructed as a rigid element which spans the gap between a pair of adjacent platforms 24. Each damper 30, when installed, has a radially outward facing surface 32 contacting the radially inner surfaces 24*a* of the adjacent platforms 24. A friction force is thereby applied by the damper 30 to the platforms 24. This friction force reduces blade to blade vibration and consequently reduces individual blade vibration. Conventionally, the dampers 30 of the blade row were designed to be identical to each other.

An underlying idea of the illustrated embodiments involves designing the bladed rotor system 10 to have alternate mistuning of blade frequencies by modifying the mass of the dampers 30 in an alternating pattern.

Figure 2:
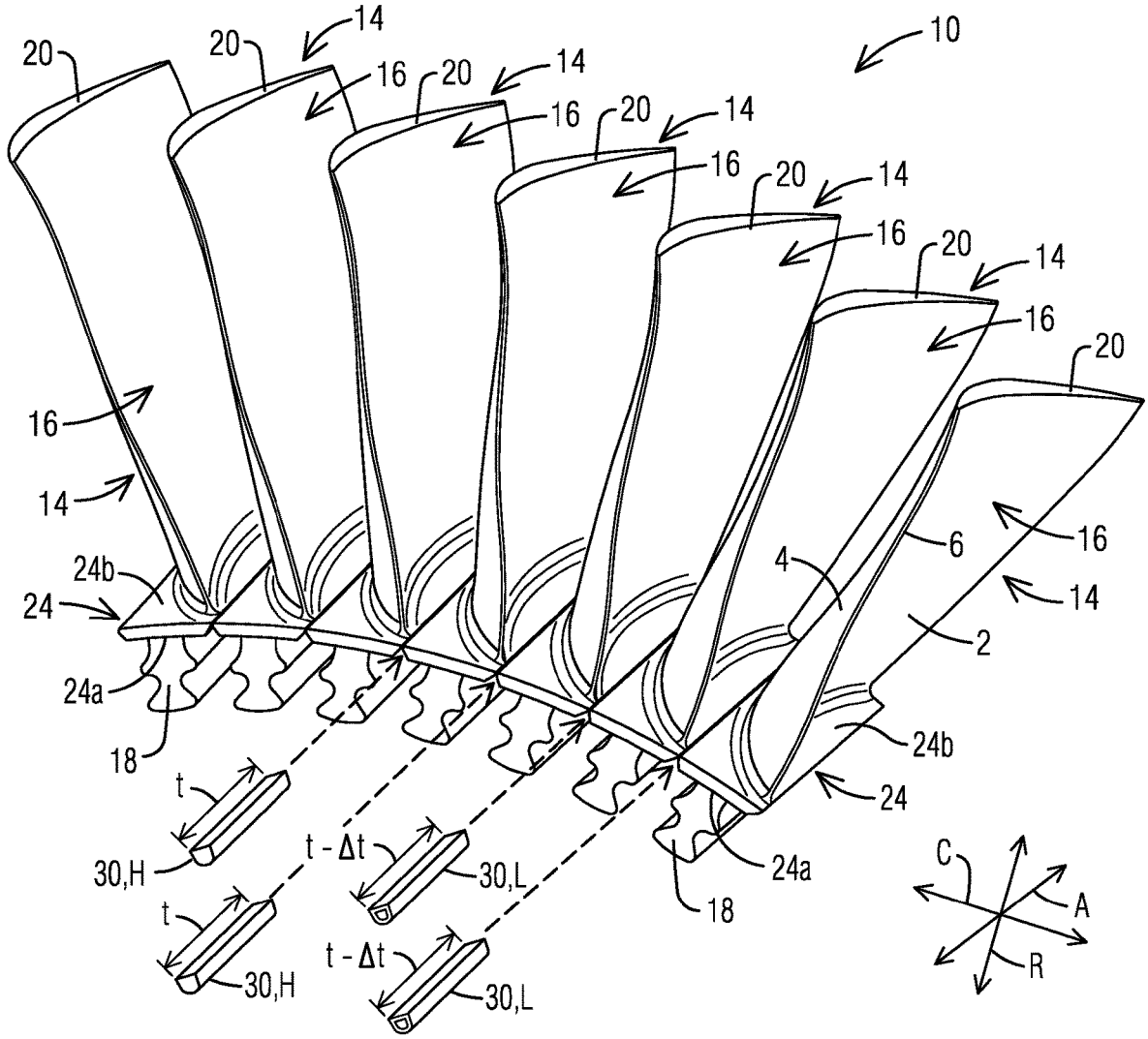
FIG. 2 schematically illustrates, in perspective view, an embodiment of the present invention implementing mistuning of under-platform dampers.

FIG. 2 schematically illustrates an arrangement of mistuned under-platform dampers 30 according to an aspect of the present invention. Herein, the dampers 30 of the bladed rotor system 10 may be divided into first and second sets of dampers 30, designated respectively as H and L. As described herein, the dampers 30 of the first set H are distinguished from the dampers 30 of the second set L by a cross-sectional material distribution of the damper 30 that is unique to the respective set H or L. Dampers 30 of the first set H and the second set L may be positioned alternately in a periodic fashion in the circumferential direction, to provide a frequency mistuning to stabilize flutter of the blades 14. In this specification, the term "set" may refer to a single damper or a plurality of identical dampers. The term "alternately" may refer to every other damper, or include a continuous group of dampers with similar vibratory characteristics. In the illustrated embodiment, the dampers 30 of the first set H and the second set L alternate in groups of two in a circumferential direction, in a pattern HHLLHH. In further embodiments groups of one or more dampers of the first set H and the second set L may alternate in a periodic fashion along the circumferential direction in the blade row, for example in patterns including HHLLHH, HHHLLHHH, HHHLLLHHH etc.

Figure 3:
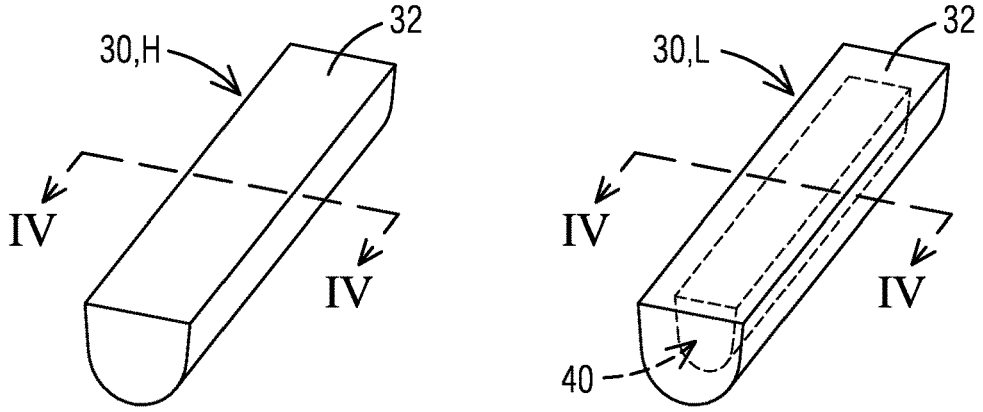
FIG. 3 schematically illustrates a first example configuration of under-platform dampers with varying cross-sectional material distribution.
Figure 4:
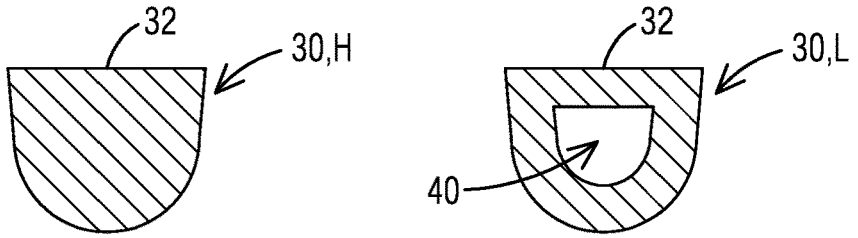
FIG. 4 illustrates cross-sectional views of the dampers shown in FIG. 3.

A first example embodiment is illustrated in FIGS. 3 and 4. In this embodiment, the dampers 30, H of the first set H are solid, while the dampers 30, L of the second set L are hollow, each defining an internal cavity 40 therewithin. The cavity 40 may extend along the entire axial length of the damper 30, L. In one embodiment, the dampers 30 of both the first set H and the second set L are made of the same material. The size of the cavity 40 may be suitably determined to achieve a pre-determined difference in material damping for the hollow dampers 30, L of the second set L in relation to the solid dampers 30, H of the first set H. On the basis of the variation in material damping of the dampers 30 between the two sets H and L, a desired frequency mistuning may be achieved by positioning the dampers 30 of the first set H and the second set L alternately in a periodic fashion in the circumferential direction of the bladed rotor system 10, as described above.

Figure 5:
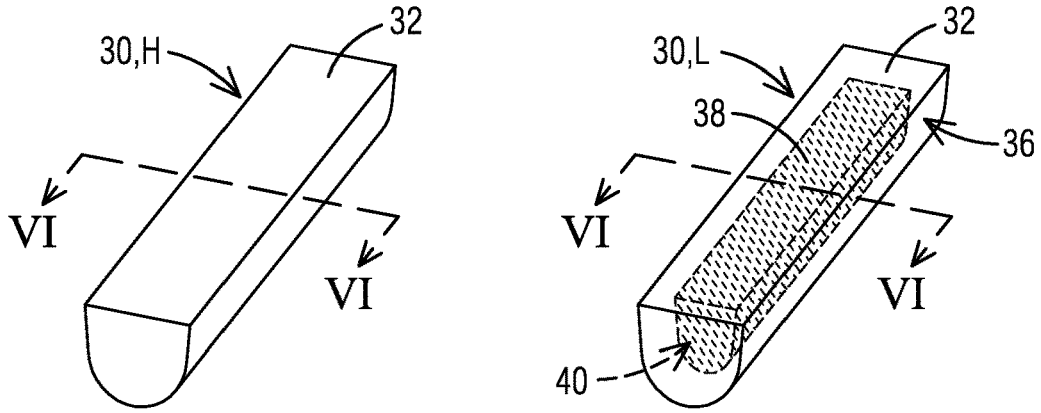
FIG. 5 schematically illustrates a second example configuration of under-platform dampers with varying cross-sectional material distribution.
Figure 6:
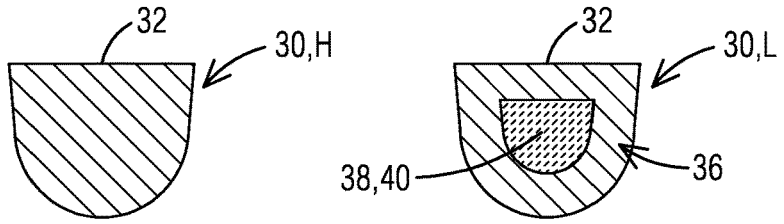
FIG. 6 illustrates cross-sectional views of the dampers shown in FIG. 5.

In a second example embodiment, as illustrated in FIGS. 5 and 6, a modification of material damping may be achieved by using solid dampers in combination with dampers formed of a hybrid material. In this embodiment, the dampers 30, H of the first set H are solid and formed uniformly of a single material, while the dampers 30, L of the second set L are formed of a hybrid material. Dampers formed of a hybrid material are herein referred to "hybrid dampers". In the embodiment shown in FIGS. 5 and 6, a hybrid damper 30, L includes an outer body 36 with an axially extending cavity 40 formed therewithin. The configuration of the outer body 36 may be similar to that of the hollow dampers 30, L of the previous embodiment (FIG. 3-4), where the cavity 40 is visible. The outer body 36 has a surface 32, which, when installed, frictionally contacts the radially inner surface 24*a* of adjacent platforms 24. The hybrid damper 30, L in this embodiment further includes an insert 38 disposed in the cavity 40 formed in the outer body 36. The insert 38 may be inserted axially through the cavity 40 of the outer body 36. Subsequently, the axial ends of the outer body 36 may be closed, for example by a respective cover welded at the axial ends (not shown in the drawings).

In the present example embodiment, the outer body 36 and the insert 38 are formed of different materials. In one embodiment, the outer body 36 of the hybrid dampers 30, L may be formed of the same material as that of the solid dampers 30, H. The material of the insert 38 may, for example, include a viscoelastic material, such as a ceramic matrix composite (CMC). The size and material of the insert 38 may be selected to provide a predetermined difference in material damping of the hybrid dampers 30, L, of the second set L in relation to the solid dampers 30, H of the first set H. On the basis of the variation in material damping of the dampers 30 between the two sets H and L, a desired frequency mistuning may be achieved by positioning the dampers 30 of the first set H and the second set L alternately in a periodic fashion in the circumferential direction of the bladed rotor system 10, as described above.

Figure 7:
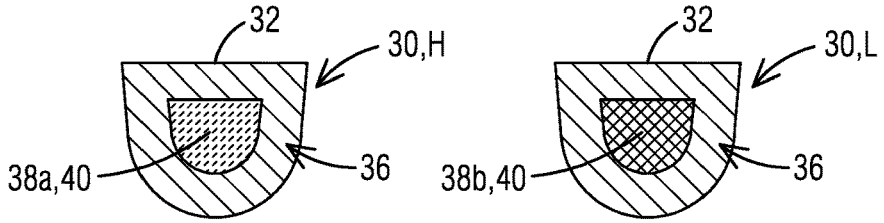
FIG. 7 illustrates cross-sectional views of dampers according to a third example configuration of under-platform dampers with varying cross-sectional material distribution.

In a third example embodiment, as shown in FIG. 7, the dampers 30 of both the first set H and the second set L may be configured as hybrid dampers. As shown, the dampers 30 of each set H and L include an outer body 36 with an axially extending cavity 40 formed therewithin. The configuration of the outer body 36 may be similar to that shown in the previous embodiment (FIG. 5-6). The outer body 36 has a surface 32, which, when installed, frictionally contacts the radially inner surface 24*a* of adjacent platforms 24. Each hybrid damper 30 of each set H and L further includes respectively an axially extending insert 38*a*, 38*b* disposed in the cavity 40 formed in the outer body 36. The material of the outer body 36 is different from the material of the respective insert 38*a*, 38*b*. The dampers 30 of the first set H are distinguished from the dampers 30 of the second set L by the material of the insert 38*a*, 38*b* that is unique to the respective set H, L. In this case, the material of the outer body 36 may be the same for the dampers 30 of both sets H and L. The materials of the inserts 38*a*, 38*b* used in the first set H and the second set L may be selected to provide a predetermined difference in material damping between the dampers 30 of the two sets H and L.

Figure 8:
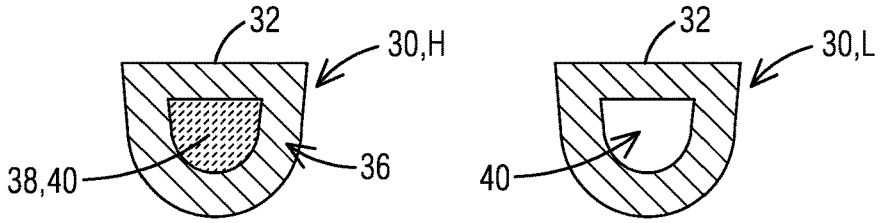
FIG. 8 illustrates cross-sectional views of the dampers according to a fourth example configuration of under-platform dampers with varying cross-sectional material distribution.

In a fourth example embodiment, as shown in FIG. 8, a modification of material damping may be achieved by using hybrid dampers in combination with hollow dampers. As described in the previous embodiments, each hybrid damper 30, H may include an outer body 36 frictionally contacting the radially inner surface 24*a* of the adjacent platforms 24. The outer body 36 has an axially extending cavity 40 formed therewithin. An axially extending insert 38 is disposed in the cavity 40 formed in the outer body 36. The insert 38 is formed of a material different from that of the outer body 36. The dampers 30, L of the second set L are hollow, each defining an internal cavity 40 therewithin. The hybrid dampers 30, H and the hollow dampers 30, L may be configured to provide a predetermined difference in material damping, to achieve a desired alternate frequency mistuning.

In all of the embodiments illustrated above, the dampers 30 of the first set H and the dampers 30 of the second set L have identical outer geometries. The outer geometry may be defined, for example, by the cross-sectional shape and axial length of the dampers 30. In these embodiments, alternate mistuning is achieved by varying the material damping of the dampers 30 between the two sets H and L, independent of the nature of frictional contact between the dampers 30 and the radially inner surface 24*a* of the platform 24. Having the same damper outer geometry may allow for a uniform under-platform geometry for the entire row of blades, as well as simpler installations.

It has been recognized that the contact loading of a damper, during operation, is a function of the cross-sectional shape of the damper along the area of contact with the platform. Accordingly, in further embodiments, the dampers 30 of the first set H may be additionally distinguished from the dampers 30 of the second set L by an outer geometry of the damper 30 that is unique to the respective set H, L. The variation in outer geometry may include a variation of cross-sectional geometry and/or axial length of the dampers 30. Various cross-sectional damper geometries, may include, without limitation, a semi-circular shape. a circular shape, a wedge shape, or an asymmetrical shape, among others. Furthermore, the damper cross-sections may be uniform across the axial length of the dampers 30, or may vary along said axial length.

The embodiments illustrated herein are directed to free-standing blades. In the context of this specification, a free-standing blade may be understood to be an unshrouded blade, i.e., a rotatable blade comprising an airfoil extending span-wise radially outward from a blade platform to an airfoil tip, without any shroud attached to the airfoil at the tip or at any point between the platform and the airfoil tip. However, the illustrated embodiments are exemplary, and aspects of the present invention may be extended to shrouded blades.

As illustrated herein, the above-described alternate mistuning may be achieved without modifying the geometry of the airfoils. That is, all the airfoils 16 in the circumferential row of blades 14 may have essentially identical cross-sectional geometry about a rotation axis 22. This makes it easier to design the airfoil to have optimum aerodynamic efficiency since a uniform airfoil geometry has to be considered. Moreover, the illustrated embodiments make it possible to employ alternate mistuning for blades with hollow airfoils, for example, containing internal cooling channels. The design of hollow airfoils is more constrained than the design of solid airfoils. The use of mistuned under-platform dampers provides a possibility for implementing alternate mistuning for such hollow blades without compromising the aero-efficiency.

Aspects of the present invention may also be incorporated in a service upgrade method, whereby an intentional alternate mistuning may be introduced in an existing row of blades, to improve flutter resistance of the blades. This may be achieved by modifying the mass of at least a subset of the existing dampers, or by providing replacement dampers, such that one or more of the inventive concepts described above are realized. As discussed above, the modification of the mass may include, for example, forming an axial cavity through an existing solid damper to form a hollow damper. Additionally or alternately, as discussed above, the modification may include forming a hybrid damper from a solid damper formed uniformly of a single material. Such a modification may include forming an axial cavity through the solid damper and subsequently disposing an insert in the axial cavity, the insert being made of a different material than that of the solid damper.

Figure 9:
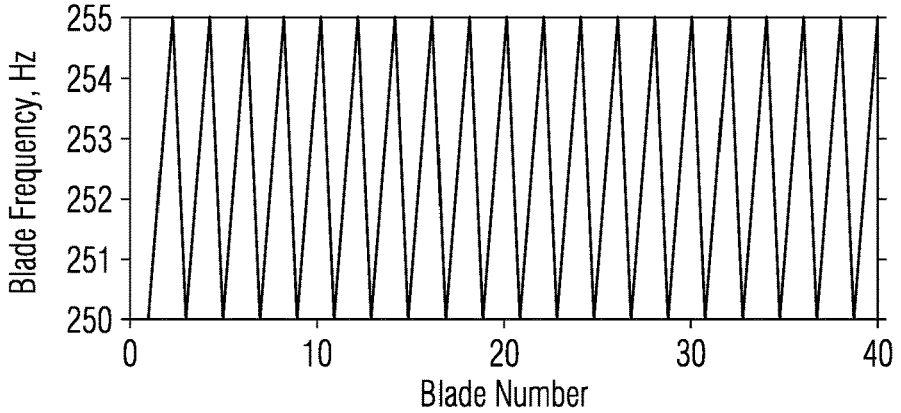
FIG. 9 graphically illustrates alternate mistuning in a row of turbine blades.

As an example, to effectively stabilize flutter, the under-platform damper geometries may be modified to achieve a mistuning of about 1.5-2% above manufacturing tolerances. FIG. 9 graphically illustrates alternate mistuning in a row of 40 turbine blades. Herein, the odd number blades have a frequency of 250 Hz, while the even numbered blades have a frequency of 255 Hz. In this example, the difference in blade frequencies is 5 Hz. Consequently, the frequency of even numbered blades is 2% than the frequency of odd numbered blades, i.e., the amount of mistuning is 2%.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A bladed rotor system for a turbomachine, comprising:

a circumferential row of blades mounted on a rotor disc, each blade comprising:

a platform;

a root extending radially inward from the platform for mounting the blade to the rotor disc; and an airfoil extending span-wise radially outward from the platform;

wherein platforms of adjacent blades align circumferentially to define an inner diameter boundary for a working fluid flow path; and a plurality of dampers, each damper being located between adjacent platforms;

wherein the plurality of dampers comprise a first set of dampers and a second set of dampers, wherein the dampers of the first set are distinguished from the dampers of the second set by a cross-sectional material distribution in the damper that is unique to the respective set, wherein dampers of the first set and the second set are positioned alternately in a periodic fashion in a circumferential direction, to provide a frequency mistuning to stabilize flutter of the blades, and wherein the dampers of the first set and the dampers of the second set have identical outer geometries and identical dimensions.

2. The bladed rotor system according to claim 1, wherein the dampers of the first set are solid, and the dampers of the second set are hollow, each defining an internal cavity therewithin.

3. The bladed rotor system according to claim 2, wherein the dampers of the first set and the dampers of the second set are made of the same material.

4. The bladed rotor system according to claim 1, wherein the dampers of the first set are solid and formed uniformly of a single material, and the dampers of the second set are formed of a hybrid material.

5. The bladed rotor system according to claim 4, wherein the dampers of the second set comprise:

an outer body frictionally contacting a respective radially inner surface of said adjacent platforms, the outer body having an axially extending cavity formed therewithin, the outer body being formed of a first material, and an axially extending insert disposed in the cavity formed in the outer body, the insert being formed of a second material different from the first material.

6. The bladed rotor system according to claim 5, wherein the second material includes a viscoelastic material.

7. The bladed rotor system according to claim 6, wherein the second material comprises a ceramic matrix composite.

8. The bladed rotor system according to claim 5, wherein the dampers of the first set are uniformly formed of said first material.

9. The bladed rotor system according to claim 1, wherein each of the dampers of the first set and the second set comprises:

an outer body frictionally contacting a respective radially inner surface of said adjacent platforms, the outer body having an axially extending cavity formed therewithin, and an axially extending insert disposed in the cavity formed in the outer body, the insert being formed of a material different from that of the outer body, wherein the dampers of the first set are distinguished from the dampers of the second set by the material of the insert that is unique to the respective set.

10. The bladed rotor system according to claim 1, wherein the dampers of the first set comprise:

an outer body frictionally contacting a respective radially inner surface of said adjacent platforms, the outer body having an axially extending cavity formed therewithin, and an axially extending insert disposed in the cavity formed in the outer body, the insert being formed of a material different from that of the outer body, wherein the dampers of the second set are hollow, each defining an internal cavity therewithin.

11. The bladed rotor system according to claim 1, wherein said circumferential row is a row of free-standing blades.

12. The bladed rotor system according to claim 1, wherein the airfoils in the circumferential row of blades have an identical cross-sectional geometry about a rotation axis.

13. A method for servicing a bladed rotor system:

wherein the bladed rotor system comprises:

a circumferential row of blades mounted on a rotor disc, each blade comprising a platform, a root extending radially inward from the platform for mounting the blade to the rotor disc, and an airfoil extending span-wise radially outward from the platform; and a plurality of dampers, each damper being installed between adjacent platforms;

wherein the method comprises:

modifying a mass of at least a subset of the plurality of installed dampers or providing replacement dampers for at least a subset of the plurality of installed dampers, so as to resultantly obtain a first set of dampers and a second set of dampers, wherein the dampers of the first set are distinguished from the dampers of the second set by a cross-sectional material distribution in the damper that is unique to the respective set, and installing the modified or replacement dampers, such that dampers of the first set and the second set are positioned alternately in a periodic fashion in a circumferential direction, to provide a frequency mistuning to stabilize flutter of the blades, wherein the dampers of the first set and the dampers of the second set have identical outer geometries and identical dimensions.

* * * * *